US009704468B2

(12) United States Patent
Davidson et al.

(10) Patent No.: US 9,704,468 B2
(45) **Date of Patent: *Jul. 11, 2017**

(54) APPARATUS AND METHOD FOR CANCELLING, REDUCING AND MODULATING NOISE SIGNAL AND FOR SIGNAL ENHANCING AND SIGNAL PROOFING

(71) Applicant: UNR, LLC, Scottsdale, AZ (US)

(72) Inventors: Lance Samuel Davidson, Scottsdale, AZ (US); Dennis Lee Edwards, Scottsdale, AZ (US)

(73) Assignee: UNR, LLC., Scottsdale ( * ) Notice: Subject to any disclaimer, the term of this patent is extended or adjusted under 35 U.S.C. 154(b) by 0 days.

This patent is subject to a terminal disclaimer.

(21) Appl. No.: 14/862,155

(22) Filed: Sep. 23, 2015

(65) Prior Publication Data

US 2016/0019880 A1 Jan. 21, 2016

Related U.S. Application Data

(63) Continuation-in-part of application No. 12/636,709, filed on Dec. 12, 2009, now Pat. No. 9,171,537.

(51) Int. Cl.

| | |
|---|---|
| ***G10K 11/16*** | (2006.01) |
| ***G10K 11/178*** | (2006.01) |
| ***H04R 1/10*** | (2006.01) |

(52) U.S. Cl.

CPC ..... *G10K 11/178* (2013.01); *H04R 1/1083* (2013.01); *G10K 2210/108* (2013.01); *G10K 2210/128* (2013.01); *G10K 2210/129* (2013.01)

(58) Field of Classification Search

CPC ..... H03D 7/00; H03D 7/1441; H03D 7/1475; H04B 1/0025; H04B 1/16; H04B 1/28; H04B 7/12; H04B 2203/5416; H04B 2203/5425; H04B 3/54; H04B 15/00; H04B 2203/5483; H04B 2203/5491; H04B 7/0408; H04B 7/10; H04B 7/155; H04R 1/1083

USPC ..... 381/807, 268, 400.09, 400.11, 434, 811, 381/161, 400.08, 400.13, 400.17, 400.2, 381/400.26, 400.3, 432, 461, 503, 599, 381/605, 727, 801, 812

See application file for complete search history.

(56) References Cited

U.S. PATENT DOCUMENTS

| | | | | |
|---|---|---|---|---|
| 2006/0018764 | A1 * | 1/2006 | Schnetzka | F04C 29/06 417/44.1 |
| 2006/0138994 | A1 * | 6/2006 | Cheng | H02M 7/53875 318/807 |
| 2009/0279336 | A1 * | 11/2009 | Erdman | H02M 7/53875 363/131 |

* cited by examiner

*Primary Examiner* — Akelaw Teshale

(74) *Attorney, Agent, or Firm* — Barry Choobin; Patent 360 LLC

(57) ABSTRACT

The embodiments herein provide an apparatus and method for cancelling signal noise. According to one embodiment, an apparatus for cancelling signal noise has a sensor or receiver to capture the undesirable signals. A transducer converts the energy of the captured signals and modulates the captured undesirable signals. A signal inverting circuit is connected to the transducer to generate the inverse of the captured undesirable signals by inverting the amplitude of the undesirable signal while maintain the frequency at the same level. The generated inverse of the undesirable signal transmitted by a transmitter is received by a receiver and output through a speaker so that the output inverse of the undesirable signal is combined with the undesirable signal to produce a desired signal environment.

32 Claims, 7 Drawing Sheets

APPARATUS AND METHOD FOR CANCELLING, REDUCING AND MODULATING NOISE SIGNAL AND FOR SIGNAL ENHANCING AND SIGNAL PROOFING

CROSS REFERENCE TO RELATED APPLICATION

The present application claims the benefit and the priority of an earlier filed Provisional application with Application Ser. No. 61/201,558 filed on Dec. 12, 2008 and the Non Provisional application with Ser. No. 12/636,709 filed on Dec. 12, 2009 and the entire contents of the above applications are included as reference herein. This application herein is a C-I-P application to the application with Ser. No. 12/636,709 filed on Dec. 12, 2009, and the entire contents of which is incorporated by reference herein.

BACKGROUND

Technical Field

The embodiments herein generally relate to noise signal reducing apparatus and methods and particularly to cancelling device and method for noise signals. More particularly the embodiments herein relate to an apparatus and methods for cancelling, reducing and/or modulating noise signals and for signal enhancement and signal-proofing with a wireless and/or wired apparatus.

Description of the Related Art

Often, the public, businessmen, the military and professionals endure constant, varying and distracting noise. Hence, environmental noise has become a very significant issue for many homes, businesses and other institutions. A variety of different factors contribute to the problem of environmental noise pollution. The different factors include increasing population density, per capita space reduction, and increasing levels of industrial, transportation and residential noise. Noise sources are increasingly perceived as environmental pollution and are considered to be a diminution of quality of life. Examples of the noise sources include but are not limited to roads and freeways, airplanes, industrial institutions, plants and factories, air conditioners and pool equipment, and many others.

Accordingly, it is desirable to have an apparatus for reducing the environmental noise and enable an individual/subject to establish, on command, absolute or a desired level of silence. Further, it is desirable to have an apparatus and method to enable a person or persons to resist, exclude or modulate a variety of signals in a variety of locales. For example, a hotel room in a densely populated urban area could reduce traffic noise, a military debriefing room could be made 'secure,' and a classroom could be improved to avoid undesired stimuli that would otherwise distract learning students.

Hence, there is a need to provide an efficient system and methods for cancelling, reducing and/or modulating noise signals and for signal enhancement and signal proofing with a wireless and/or wired apparatus.

The above-mentioned shortcomings, disadvantages and problems are addressed herein and will be understood by reading and studying the following specification.

OBJECTIVES OF THE EMBODIMENTS HEREIN

The primary object of the embodiments herein is to provide an apparatus and methods for cancelling, reducing and/or modulating noise signals and for signal enhancement and signal-proofing.

Another object of the embodiments herein is to provide an efficient, practical, simple apparatus and/or methods to eliminate or significantly reduce undesirable signals.

Yet another object of the embodiments herein is to provide an efficient, practical, simple apparatus and/or methods to enhance signals, substitute signals, isolate signals, signal-proof and modulate signals.

Yet another object of the embodiments herein is to provide an efficient, practical, simple apparatus and/or methods that is operated irrespective of whether the apparatus is in proximity and/or remote to the subject/individual.

Yet another object of the embodiments herein is to provide an efficient, practical, simple apparatus and/or methods that will transmit silencing descriptor information to a receiver or receivers for signal or noise cancellation.

Yet another object of the embodiments herein is to provide an apparatus consisting of devices that are operated remotely, automatically and/or manually for signal noise modulation, signal noise reduction, signal noise cancellation, signal enhancement and signal-proofing.

Yet another object of the embodiments herein is to provide a system and method for providing signal noise modulation, signal noise reduction, signal noise cancellation, signal enhancement, and signal-proofing using all isolated devices.

Yet another object of the embodiments herein is to provide a system and method with directional technology to isolate sounds in a designated area for providing signal noise modulation, signal noise reduction, signal noise cancellation, signal enhancement, and signal-proofing.

Yet another object of the embodiments herein is to provide a system and method for assigning geo-tags to the operating devices for enabling a user to remotely, automatically and/or manually adjust the settings so that the apparatus components remember the selected settings to prevent the resetting of the devices when the user enters that location at succeeding times.

Yet another object of the embodiments herein is to provide a system and method for directly integrating the computing and telephone devices such as smartphones, tablets and computers for automatic, manual and/or remote controlling of the device settings such as volume control and tuning frequency control.

Yet another object of the embodiments herein is to provide a system and method with a whistle protection application to reduce any feedback.

Yet another object of the embodiments herein is to provide a system and method that is operable on one or more wireless and/or wired apparatus.

Yet another object of the embodiments herein is to provide a system and method with a noise memory application to enable the apparatus to store the sound/frequency patterns of noises so that an active noise cancellation is activated remotely, automatically and/or manually, similar to memory car seats used for recalling a driver's preset seat position in a vehicle, when a noise is recognized based on the stored noise frequency or noise pattern in a designated area.

Yet another object of the embodiments herein is to provide a system and method with a noise anticipation application so that the devices anticipate noises heuristically, similar to Pandora software for music used for anticipating the listener's music choices.

Yet another object of the embodiments herein is to provide a system and method for integrating directional and multi-directional microphone device(s) for signal noise modulation, signal noise reduction, signal noise cancellation, signal enhancement, and signal-proofing.

Yet another object of the embodiments herein is to provide a system and method in which a plurality of devices consisting of one or more microphones, speakers, transmitters, transducers and/or receivers is integrated to amplify localized sound(s) against ambient noise that is 'silenced'/canceled.

Yet another object of the embodiments herein is to provide a system and method in which a plurality of devices consisting of one or more microphones, transmitters and/or receivers is integrated to 'silence' localized sound(s) in addition to ambient noise via noise cancelation.

Yet another object of the embodiments herein is to provide a system and method in which a plurality of devices consisting of one or more microphones, transmitters and/or receivers, and phase and/or anti-phase microphones is integrated for silencing or amplifying sound within one or more designated spaces/areas in addition to a silencing noise exterior to one or more designated spaces/areas.

Yet another object of the embodiments herein is to provide an apparatus consisting of devices that are operated remotely, automatically and/or manually for signal noise modulation, signal noise reduction, signal noise cancellation, signal enhancement, and signal-proofing.

Yet another object of the embodiments herein is to provide a system and method for selecting the entire spectrum of frequencies of noise in one or more designated space/area for generating an inverse signal to blanket and/or silence the entire spectrum of frequencies of noise in the designated space/area.

Yet another object of the embodiments herein is to provide a system and method in which the sensor and receiver are tuned remotely, manually and/or automatically to a specific frequency and carry the inverted signal from spaces/areas external to the designated space/area. The user manually, automatically and/or remotely adjusts the volume of the receiver to adjust the degree of noise cancellation.

These and other objects and advantages of the embodiments herein will become readily apparent from the following detailed description taken in conjunction with the accompanying drawings.

SUMMARY

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concept of the invention in a simplified form as a prelude to the more detailed description that is presented later.

The embodiments herein relate generally to, among other things, the fields of military and diplomatic intelligence gathering, and delivery of intelligence and misinformation; auditory and medical research; consumer appliances; business appliances; education; electronic technology; private and public auditoria for orchestras, theater, etc., and robot technology.

The term "noise" wherever mentioned in the specification, or claims and/or drawings, means an undesirable signal or signals. The term "undesirable signal" wherever mentioned in the specification, or claims and/or drawings refers to a signal that is undesirable or disquieting to one or more individuals, one or more subjects, one or more objects, and/or any mixture of subjects and object. The term 'signal' is not limited to just sound waves, but also includes light particles, smell particles, touch/sensation signals, and taste signals. The terms 'signal,' 'sensor,' 'device,' 'apparatus,' 'frequency,' 'receiver,' 'transmitter,' 'microphone,' 'switch,' 'antenna,' 'speaker,' 'amplifier,' 'subject,' 'object,' 'component,' 'transducer,' 'circuit,' 'space,' 'area' and 'power supply' wherever mentioned in the specification, or claims and/or drawings in the singular also include the same in pluralities, and vice-versa. The terms "cancelation" and "cancel" wherever mentioned in the specification, or claims and/or drawings, and when used in conjunction with sound(s) or signal(s) include reduction, modulation, canceling, enhancement and proofing where the context so permits. The term "designated area/space" wherever mentioned in the specification, or claims and/or drawings, also refers to a plurality of designated areas/spaces.

The embodiments herein provide an apparatus and methods for cancelling, reducing and/or modulating noise signals and for signal enhancement and signal-proofing with a wireless and/or wired apparatus. Examples of the signal noise include, but are not limited to sound signal, light signal, smell signal touch or sensation signal and taste signal. According to one embodiment, an apparatus for cancelling signal noise has a means for capturing undesirable signals, especially from one area to another designated area. The designated area includes an open area or confined area or enclosed area. A transducer is connected to the means for capturing the undesirable signals, for receiving the captured undesirable signals, for converting the energy of the captured signals and for modulating the captured undesirable signals. The sound waves in this embodiment are converted into analog signals. A signal-inverting circuit is connected to the transducer to generate the inverse of the captured undesirable signals. A means for transmitting is connected to the signal inverting circuit to transmit the output of the signal inverting circuit. A means for communications is provided to communicate the output of the signal inverting circuit transmitted using the means for transmitting. A means for receiving is provided to receive the inverted signal transmitted by the means for transmitting. A signal output device is connected to the means for receiving to output the inverted signal received by the means for receiving. A power source is provided to supply power to all the components in the apparatus.

The signal output device outputs the inverted signal received by the means for receiving to cancel the undesirable signal. The means for capturing the undesirable signal is a sensor or a receiver for detecting an undesirable signal. The sensor or receiver is automatically tuned to a specific frequency of the signal. The sensor or the receiver has a feature for adjusting the volume of the specific signal for achieving any desired degree of noise cancellation.

The signal inverting circuit generates a signal which is the inverse of the undesirable signal captured by the means for capturing. The output signal from the signal inverting circuit has an amplitude which is inverse of the captured, undesired signal and a frequency which is same as the frequency of the captured, undesired signal. The undesired signal is a signal selected from a group comprising noise, undesirable sounds, visual stimuli, touch stimuli and taste stimuli.

The means for communications is a wired network to communicate the output of the signal inverting circuit, which is transmitted using the means for transmitting. The means for communications is a wireless network to communicate the output of the signal inverting circuit, which is transmitted using the means for transmitting. The transmitted inverse of the captured undesirable signal is communicated through a fully or partially wireless network. The transmitted inverse of the captured undesirable signal is communicated through a fully/partially wired and/or fully/partially wireless network or optical communications system.

According to an embodiment herein, the sensor or receiver is remotely, automatically and/or manually tuned to the frequency or frequencies of the undesirable signal or signals.

According to an embodiment herein, the receiver is remotely, manually and/or automatically controlled to vary the volume of an output signal from the receiver with respect to a volume of a noise to vary a degree of noise cancellation.

According to an embodiment herein, the sensor or receiver is tuned to receive an entire spectrum of noise or sound frequency coming from an area outside designated space/area.

According to an embodiment herein, the signal inverting circuit generates an inverse signal of the entire spectrum of received noise or sound frequency.

According to an embodiment herein, one or more microphones, speakers, transmitters, transducers and/or receivers are integrated to amplify localized sound against ambient noise that is silenced or canceled.

According to an embodiment herein, the one or more microphones, speakers, transmitters, transducers and/or receivers are integrated to silence localized sound in addition to ambient noise via noise cancelation.

According to an embodiment herein, the one or more microphones, speakers, transmitters, transducers, receivers and phase and/or anti-phase microphones are integrated for silencing or amplifying sound inside the enclosed space in addition to silencing noise exterior to the designated space/area.

According to an embodiment herein, the apparatus further comprises computing and telephone devices integrated with one or more phase and/or anti-phase microphones, speakers, transmitters, transducers, and receivers for automatic, manual and/or remote controlling of volume control settings and tuning frequency control settings.

According to an embodiment herein, the one or more phase and/or anti-phase microphones, speakers, transmitters, transducers, and receivers are provided with a directional sensor to isolate sounds in designated areas for providing signal noise modulation, signal noise reduction, signal noise cancellation, signal enhancement, and signal-proofing.

According to an embodiment herein, the one or more phase and/or anti-phase microphones, speakers, transmitters, transducers, and receivers are provided with geo-tags for enabling user to remotely, automatically or manually adjust the settings so that the one or more phase and/or anti-phase microphones, speakers, transmitters, transducers, and receivers remember the selected settings to prevent a resetting operation, when the user enters a preset location the succeeding times.

According to an embodiment herein, the apparatus further comprises a whistle protection application for reducing any feedback.

According to an embodiment herein, the apparatus further comprises a noise memory application to enable the apparatus to store with sound/frequency patterns of noises so that an active noise cancellation is activated remotely, automatically and/or manually like memory car seats used for recalling a driver's preset seat position in a vehicle, when a noise is recognized based on the stored noise frequency or noise pattern in designated areas.

According to an embodiment herein, the apparatus further comprises a noise anticipation application so that the apparatus anticipates noise heuristically, similar to Pandora software for music used for anticipating the listener's music choices.

According to one embodiment, a method for cancelling signal noise is provided. The method involves capturing undesirable signals, generating inverse signals of the captured undesirable signal, transmitting the generated inverse of the captured undesirable signal, receiving the transmitted inverse of the captured undesirable signal and outputting the received inverse of the captured undesirable signal to cancel the undesirable signal.

The undesirable signals are captured using a sensor or receiver. The captured undesirable signal is passed through a signal inverting circuit to generate the inverse of the captured undesirable signal. The inverse signal has an amplitude which is inverse of the captured undesirable signal and a frequency which is same as the frequency of the captured undesirable signal. The undesired signal is a signal selected from a group comprising noise, undesirable sounds, visual stimuli, touch stimuli and taste stimuli.

The transmitted inverse of the captured undesirable signal is communicated through a wired network. The transmitted inverse of the captured undesirable signal is communicated through a fully or partially wireless network. The transmitted inverse of the captured undesirable signal is communicated through a fully/partially wired and/or fully/partially wireless network or optical communications system.

According to an embodiment herein, a system is provided for cancelling, reducing and/or modulating noise signals and for signal enhancement and signal-proofing with wireless and/or wired devices in a plurality of designated spaces/areas.

According to an embodiment herein, a method is provided for cancelling, reducing and/or modulating noise signals and for signal enhancement and signal-proofing with wireless and/or wired devices in a plurality of designated spaces/areas.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

Figure 1:
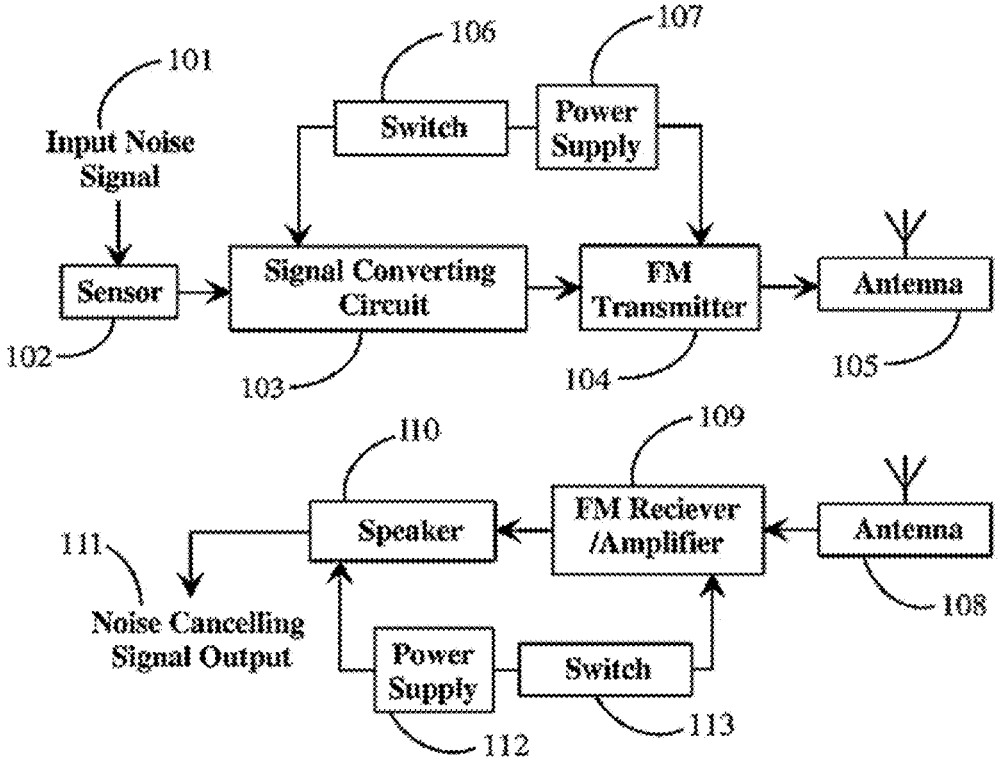
FIG. 1 illustrates a block circuit diagram of an apparatus for cancelling, reducing and/or modulating noise signal and for signal enhancing and signal proofing, according to one embodiment herein.

Although specific features of the present invention are shown in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide an apparatus and method for cancelling, modulating, reducing signal noise and for signal enhancement and signal-proofing. Examples of the signal noise include, but are not limited to sound signal, light signal, smell signal, touch or sensation signal and taste signal.

According to one embodiment, an apparatus for cancelling signal noise has a means for capturing undesirable signals. A transducer is connected to the means for capturing the undesirable signals for receiving the captured undesirable signals, for converting the energy of the captured signals and for modulating the captured undesirable signals. A signal inverting circuit is connected to the transducer to generate the inverse of the captured undesirable signals. A means for transmitting is connected to the signal inverting circuit to transmit the output of the signal inverting circuit. A means for communications is provided to communicate the output of the signal inverting circuit transmitted using the means for transmitting. A means for receiving is provided to receive the inverted signal transmitted by the means for transmitting. A signal output device is connected to the means for receiving to output the inverted signal received by the means for receiving. A power source is provided to supply power to all the components in the apparatus.

The signal output device outputs the inverted signal received by the means for receiving to cancel the undesirable signal. The means for capturing the undesirable signal is a sensor or a receiver for detecting an undesirable signal. The sensor or receiver is automatically tuned to a specific frequency of the signal. The sensor or the receiver has a feature for adjusting the volume of the specific signal for achieving any desired degree of noise cancellation.

The signal inverting circuit generates a signal which is inverse of the undesirable signal captured by the means for capturing. The output signal from the signal inverting circuit has amplitude which is inverse of the captured, undesirable signal and a frequency which is same as the frequency of the captured, undesirable signal. The undesirable signal is a signal selected from a group comprising noise, undesirable sounds, visual stimuli, touch stimuli and taste stimuli.

The means for communications is a wired network to communicate the output of the signal inverting circuit, which is transmitted using the means for transmitting. The means for communications is a fully or partially wired and/or wireless network to communicate the output of the signal inverting circuit, which is transmitted using the means for transmitting.

According to an embodiment herein, the sensor or receiver is remotely, automatically and/or manually tuned to the frequency of the undesirable signal or the frequencies of undesirable signals.

According to an embodiment herein, the receiver is automatically, manually or remotely controlled to vary the volume of an output signal from the receiver with respect to a volume of a noise to vary a degree of noise cancellation.

According to an embodiment herein, the sensor or receiver is tuned to receive an entire spectrum of noise or sound frequency coming from an area outside designated space/area.

According to an embodiment herein, the signal inverting circuit generates an inverse signal of the entire spectrum of received noise or sound frequency.

According to an embodiment herein, one or more microphones, speakers, transmitters, transducers and/or receivers are integrated to amplify localized sound against ambient noise that is silenced or canceled.

According to an embodiment herein, the one or more microphones, speakers, transmitters, transducers and/or receivers are integrated to silence localized sound in addition to ambient noise via noise cancelation.

According to an embodiment herein, the one or more phase and anti-phase microphones, speakers, transmitters, transducers and receivers are integrated for silencing and/or amplifying sound inside designated space/area in addition to a silencing noise exterior to the designated space/area.

According to an embodiment herein, the apparatus further comprises computing and telephone devices integrated with one or more phase and anti-phase microphones, speakers, transmitters, transducers and receivers for automatic, manual and/or remote controlling of volume control settings and tuning frequency control settings.

According to an embodiment herein, the one or more phase and anti-phase microphones, speakers, transmitters, transducers and receivers are provided with a directional sensor to isolate sounds in designated space/area for providing signal noise modulation, signal noise reduction, signal noise cancellation, signal enhancement, and signal-proofing.

According to an embodiment herein, the one or more phase and anti-phase microphones, speakers, transmitters, transducers and receivers are provided with geo-tags for enabling user to remotely, automatically and/or manually adjust the settings so that the one or more phase and anti-phase microphones, speakers, transmitters, transducers and receivers remember the selected settings to prevent a resetting operation, when the user enters a preset location at other times or succeeding times.

According to an embodiment herein, the apparatus further comprises a whistle protection application for reducing any feedback.

According to an embodiment herein, the apparatus further comprises a noise memory application to enable the apparatus to store with sound/frequency patterns of noises so that an active noise cancellation is activated remotely, automatically and/or manually, similar to memory car seats used for recalling a driver's preset seat position in a vehicle, when a noise is recognized based on the stored noise frequency or noise pattern in designated space/area According to an embodiment herein, the apparatus further comprises a noise anticipation application so that the apparatus anticipates noise heuristically, similar to Pandora software for music used for anticipating the listener's music choices.

According to an embodiment herein, the apparatus further comprises devices to reduce/cancel/enhance/modulate localized sounds/signals.

According to another embodiment, a method for cancelling signal noise is provided. The method involves capturing undesirable signals, generating inverse signals of the captured undesirable signal, transmitting the generated inverse of the captured undesirable signal, receiving the transmitted inverse of the captured undesirable signal and outputting the received inverse of the captured undesirable signal to cancel the undesirable signal.

The undesirable signals are captured using a sensor or receiver. The captured undesirable signal is passed through a signal inverting circuit to generate the inverse of the captured undesirable signal. The inverse signal has an amplitude which is the inverse of the captured undesirable signal and a frequency which is same as the frequency of the captured undesirable signal. The undesirable signal is a signal selected from a group comprising noise, undesirable sounds, visual stimuli, touch stimuli and taste stimuli.

The transmitted inverse of the captured undesirable signal is communicated through a wired network. The transmitted inverse of the captured undesirable signal is communicated through a fully or partially wireless network. The transmitted inverse of the captured undesirable signal is communicated through a fully/partially wired and/or fully/partially wireless network or optical communications system.

According to one embodiment, the sensor or a receiver is placed on or about a suction cup or other device attached to one or more windows to capture outside noise and transmit the signal to a stereo receiver in a house, factory or office to create silence inside residential, industrial or commercial space, respectively. The apparatus cancels the signal noise by replicating or mirroring the signal so that the listener is unaware of the undesirable ambient sound and can instead focus on the desired sound.

The sensors and receivers have the ability to automatically tune to the specific frequency of the signal and modulate/adjust volume for any desired degree of noise cancellation or to be manually and/or automatically adjusted, remotely or otherwise. The sensors and receivers, transmitters and printed circuit boards are expected to be, but need not be, in a closed or partially closed, stationary or moving (e.g., a vehicle), space. The power source for the apparatus could be AC, DC, AC/DC, battery, solar or otherwise.

The apparatus and related components need not be separate or standalone. For example, a window or wall could contain within or could be embedded with the receivers, transmitters, power sources and printed circuit boards. The signals could be electromagnetic or otherwise, and need not be within sensory receptors to the human, e.g., audible to the human ear, observable to the human eye, etc. The term 'signal' is not limited to just sound signals, but also includes light signals, smell signals, touch/sensation signals and taste signals, etc.

According to an embodiment herein, an apparatus consists of devices that are operated remotely or automatically and/or manually for signal noise modulation, signal noise reduction, signal noise cancellation, signal enhancement, and signal-proofing.

According to an embodiment herein, all the isolated devices are operated for signal noise modulation, signal noise reduction, signal noise cancellation, signal enhancement, and signal-proofing.

According to an embodiment herein, the operating devices are provided with a directional technology to isolate sounds in one or more designated spaces or areas for providing signal noise modulation, signal noise reduction, signal noise cancellation, signal enhancement, and signal-proofing.

According to an embodiment herein, the operating devices are assigned with geotags for enabling user to remotely, automatically and/or manually adjust the settings so that the apparatus components remember the selected settings to prevent the resetting of the devices when the user enters that location succeeding times.

According to an embodiment herein, the computing and telephone devices such as smartphones, tablets and computers, are directly integrated for automatic or manual and/or remote controlling of the device settings such as volume control and tuning frequency control.

According to an embodiment herein, the system is provided with a whistle protection application to reduce any feedback.

According to an embodiment herein, the system is provided with a noise memory application to enable the apparatus to store with sound/frequency patterns of noises so that an active noise cancellation is activated remotely, automatically and/or manually, similar to memory car seats used for recalling a driver's preset seat position in a vehicle, when a noise is recognized based on the stored noise frequency or noise pattern in an enclosure or premises.

According to an embodiment herein, the system is provided with a noise anticipation application so that the devices anticipates noise heuristically, similar to Pandora software for music used for anticipating the listener's music choices.

According to an embodiment herein, directional and multi-directional microphone device or microphone devices are integrated for signal noise modulation, signal noise reduction, signal noise cancellation, signal enhancement, and signal-proofing.

According to an embodiment herein, a plurality of devices consisting of one or more microphones, speakers, transmitters transducers and/or receivers is integrated to amplify localized sound against ambient noise that is 'silenced'/canceled.

According to an embodiment herein, a plurality of devices consisting of one or more microphones, transmitters and/or receivers is integrated to 'silence' localized sound in addition to ambient noise via noise cancelation.

According to an embodiment herein, a plurality of devices consisting of one or more phase and/or anti-phase microphones, transmitters and/or receivers is integrated for silencing or amplifying sound inside designated space/area in addition to a silencing a noise exterior to the designated space/area.

According to an embodiment herein, an apparatus consists of a plurality of devices that is operated remotely and automatically and/or manually for signal noise modulation, signal noise reduction, signal noise cancellation, signal enhancement, and signal-proofing.

According to an embodiment herein, the entire spectrum of frequencies of noise in designated space/area is selected for generating an inverse signal to blanket or silence the entire spectrum of frequencies of noise in a designated space/area.

According to an embodiment herein, the sensor and receiver are tuned remotely, manually and/or automatically to the specific frequency and carry the inverted signal external to the designated space/area. The user manually, automatically and/or remotely adjusts the volume of the receiver to adjust the degree of noise cancellation.

According to an embodiment herein, a system is provided for cancelling, reducing and/or modulating noise signals and for signal enhancement and signal-proofing with wireless and/or wired devices in a plurality of designated spaces/areas.

According to an embodiment herein, a method is provided for cancelling, reducing and/or modulating noise signals and for signal enhancement and signal-proofing with wireless and/or wired devices in a plurality of designated spaces/areas.

FIG. 1 illustrates a block circuit diagram of an apparatus for cancelling, reducing, and/or modulating noise signal and for signal enhancing and signal proofing, according to one embodiment. With respect to FIG. 1, sensor 102 is provided for capturing noise or undesirable signals 101. The undesirable signal is a signal selected from a group comprising noise, undesirable sounds, visual stimuli, touch stimuli and taste stimuli. The examples of the sensors include, but are not limited to, a condenser microphone for sensing a sound signal, a lens for sensing light signal and a pressure gauge for sensing touch or sensation signal. The sensed signal noise is passed to a signal inverting circuit 103 for inverting the sensed signal noise. The signal inverting circuit 103 inverts amplitude of the sensed signal noise without changing the frequency of the sensed signal noise. The signal inverting circuit 103 sends the inverted noise signal to a FM transmitter 104 provided with an antenna 105. The antenna 105 tuned to 88 MHz transmits the inverted signal noise to FM receiver 109 tuned to 88 MHz. A power supply 107 along with a switch 106 (ON/OFF modulating switch) is connected to the signal inverting circuit 103 and FM transmitter 104 to supply power during the entire process of generating and transmitting the inverted signal noise. Examples of the power supply 107 include, but are not limited to an Alternating Current (AC) source, a Direct Current (DC) source, a battery and a solar power source.

The FM receiver 109 receives the inverted signal noise through the antenna 108. The FM receiver 109 amplifies the inverted signal noise and sends the amplified inverted signal noise to a transducer such as a speaker 110. An example of the transducer 110 includes a speaker. The transducer such as speaker 110 outputs the amplified inverted noise signal 111 to the surrounding area so that the amplified inverted noise signal 11 combines with the signal noise 101 to reduce or eliminate or cancel the level of unwanted signal noise perceived by a listener. A power supply 112 along with a switch 113 (ON/OFF modulating switch) connected to the FM receiver 109 and transducer such as speaker 110 powers entire process of amplifying the inverted noise signal and producing the noise cancellation signal 111. Examples of the power supply 112 include, but are not limited to an Alternating Current (AC) source, a Direct Current (DC) source, a battery and a solar power source.

In various embodiments, the elements are populated on a Printed Circuit Board (PCB) to form a Printed Circuit Board Assembly (PCBA) for generating the noise cancellation signal 111 to cancel the signal noise so that the noise cancellation signal 111 combines with the signal noise 101 to reduce or eliminate the level of unwanted signal noise 111 perceived by a listener.

Figure 2:
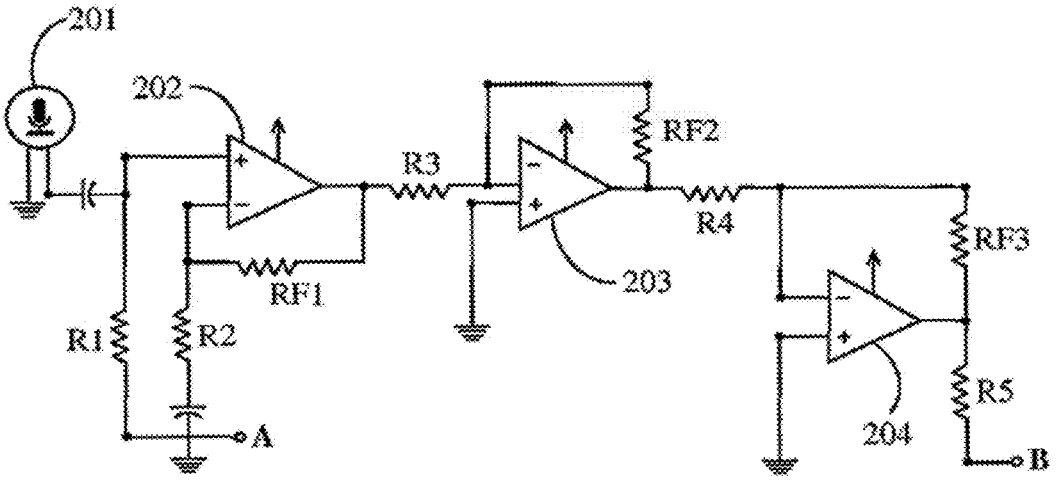
FIG. 2 is a block circuit diagram of a signal inverting circuit in an apparatus for cancelling, reducing and/or modulating noise signal and for signal enhancing and signal proofing, according to one embodiment herein.

FIG. 2 is a block circuit diagram of a signal inverting circuit in an apparatus for cancelling, reducing, and/or modulating noise signal and for signal enhancing and signal proofing, according to one embodiment. With respect to FIG. 2, the signal noise inverting circuit includes a condenser microphone 201, a High Pass Filter (HPF) and three cascaded Operational Amplifiers (OPAMs) 202-204 in series to produce an inverted signal noise for reducing the signal noise originated in a surrounding area. The condenser microphone 201 is provided for sensing the signal noise (sound signal). The signal noise (sound signal) input to the microphone 201 is passed through the HPF which includes a capacitor and resistor R.I. The HPF offers easy passage of high frequency signal noise. The sensed high frequency signal noise is fed to the noninverting input of the OPAMP 202. The inverting-input of the OPAMP 202 is grounded through a resistor R2 and a capacitor. A feedback resistor RF1 is connected from output of the OPAMP 202 to the inverting-input of the OPAMP 202 to provide a negative feedback. The OPAMP 202 inverts amplitude of the high frequency signal noise at first stage due to negative feedback provided through the resistance RF1.

The inverted high frequency signal noise output from the OPAMP 202 is fed to an OPAMP 203 through a resistance R3. Non inverting-input of the OPAMP 203 is grounded. A feedback resistor RF2 is connected from output of the OPAMP 203 to the inverting-input of the OPAMP 203. The OPAMP 203 inverts amplitude of the inverted high frequency signal noise received from the OPAMP 202 due to negative feedback provided through the resistance RF2. Further, the inverted high frequency signal noise output from the OPAMP 203 is fed to an OPAMP 204 through a resistance R4. Non inverting-input of the OPAMP 204 is grounded. A feedback resistor RF3 is connected from output of the OPAMP 204 to the inverting-input of the OPAMP 204. The OPAMP 204 inverts amplitude of the inverted high frequency signal noise received from the OPAMP 204 due to negative feedback provided through the resistance RF3. The inverted signal noise output from the OPAMP 204 forms the final output of the signal noise inverting circuit collected through load resistance R5.

Figure 3:
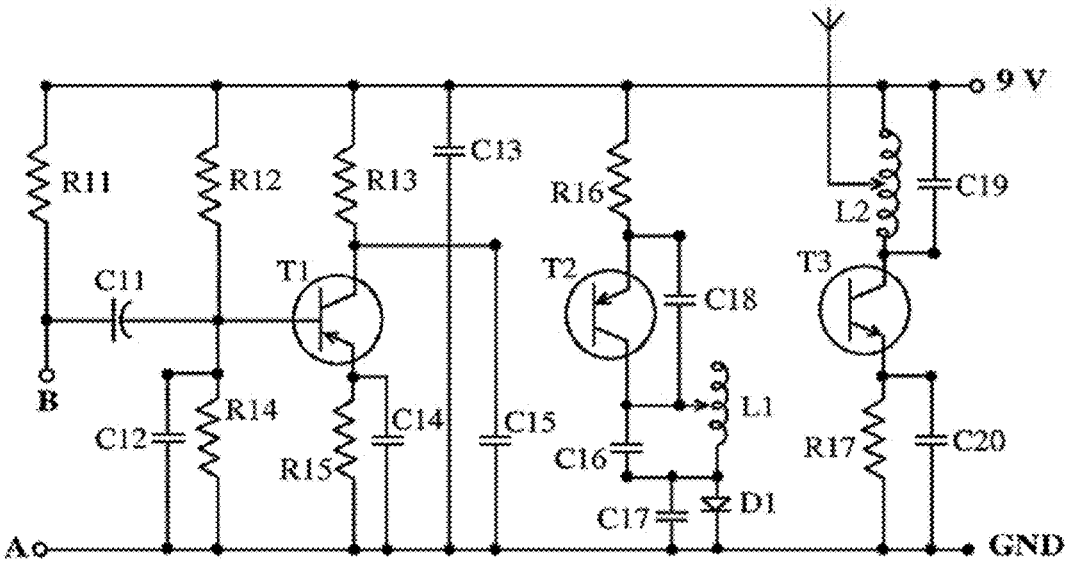
FIG. 3 is block circuit diagram of FM transmitter used in an apparatus for cancelling, reducing and/or modulating noise signal and for signal enhancing and signal proofing, according to one embodiment herein.

FIG. 3 is block circuit diagram of a FM transmitter used in an apparatus for cancelling, reducing, and/or modulating noise signal and for signal enhancing and signal proofing, according to one embodiment. With respect to FIG. 3 an inverted anti-noise signal is fed to the FM transmitter. The FM transmitter transmits the inverted noise signal over a carrier wave by changing frequency of the inverted noise signal. The FM transmitter is provided with an oscillator to generate a carrier RF signal. Frequency modulation takes place at the oscillator stage. The frequency modulated signal is passed through filter and then finally amplified by a power amplifier, and finally delivered to an antenna provided in the FM transmitter. The FM transmitter radiates the FM inverted noise signal through the antenna provided in the FM transmitter. The radiated FM inverted noise signal is transmitted to an FM receiver.

Figure 4:
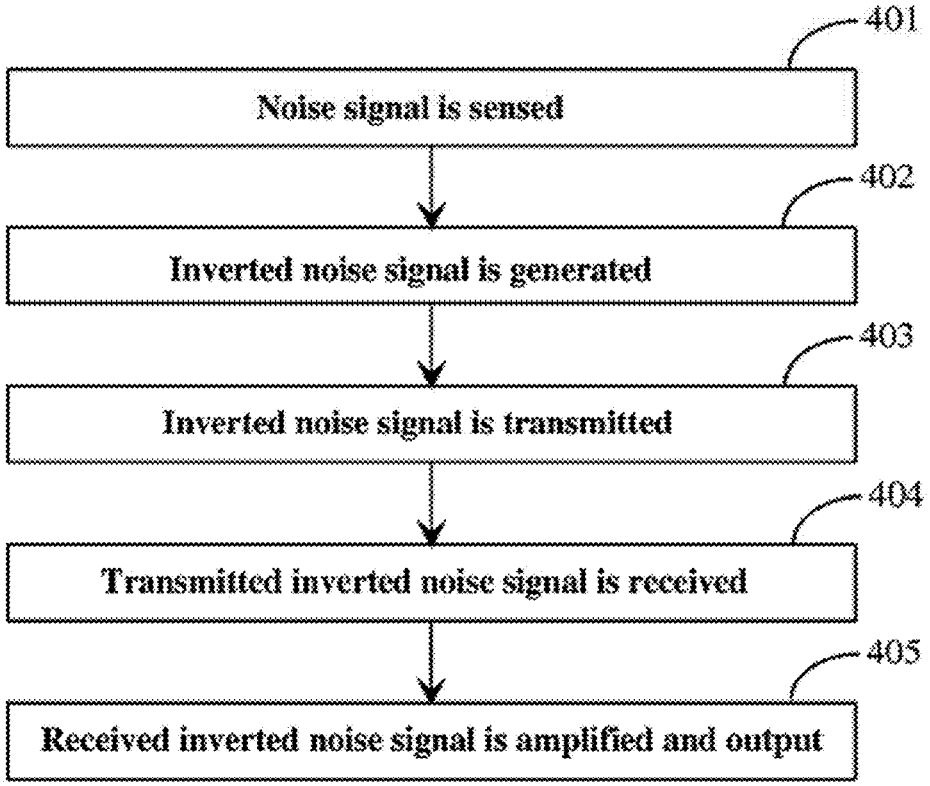
FIG. 4 is a flow chart illustrating a method for cancelling, reducing and/or modulating noise signal and for signal enhancing and signal proofing, according to one embodiment herein.

FIG. 4 is a flow chart illustrating a method for cancelling, reducing, and/or modulating noise signal and for signal enhancing and signal proofing, according to one embodiment. A signal noise is sensed or captured by a sensor or receiver (401). An inverted noise signal is generated using a signal inverting circuit. Amplitude of the sensed signal noise is inverted while the frequency of the sensed signal noise maintained at the same level (402). The generated inverted noise signal is transmitted using a FM transmitter (403). The transmitted inverted noise signal is received by a FM receiver (404). The received inverted signal is amplified and output through a transducer such as a speaker so that the amplified inverted noise signal is combined with the input signal noise to reduce or eliminate or cancel the level of unwanted signal noise perceived by a listener (405). In various embodiments, the signal noise of an exterior environment is reduced in an interior space. The signal noise of interior space is reduced within the interior space, or the signal noise of an exterior environment is reduced in the exterior environment. Examples of the noise signal include, but are not limited to a sound signal, light signal, smell signal, touch or sensation signal and taste signal.

Figure 5:
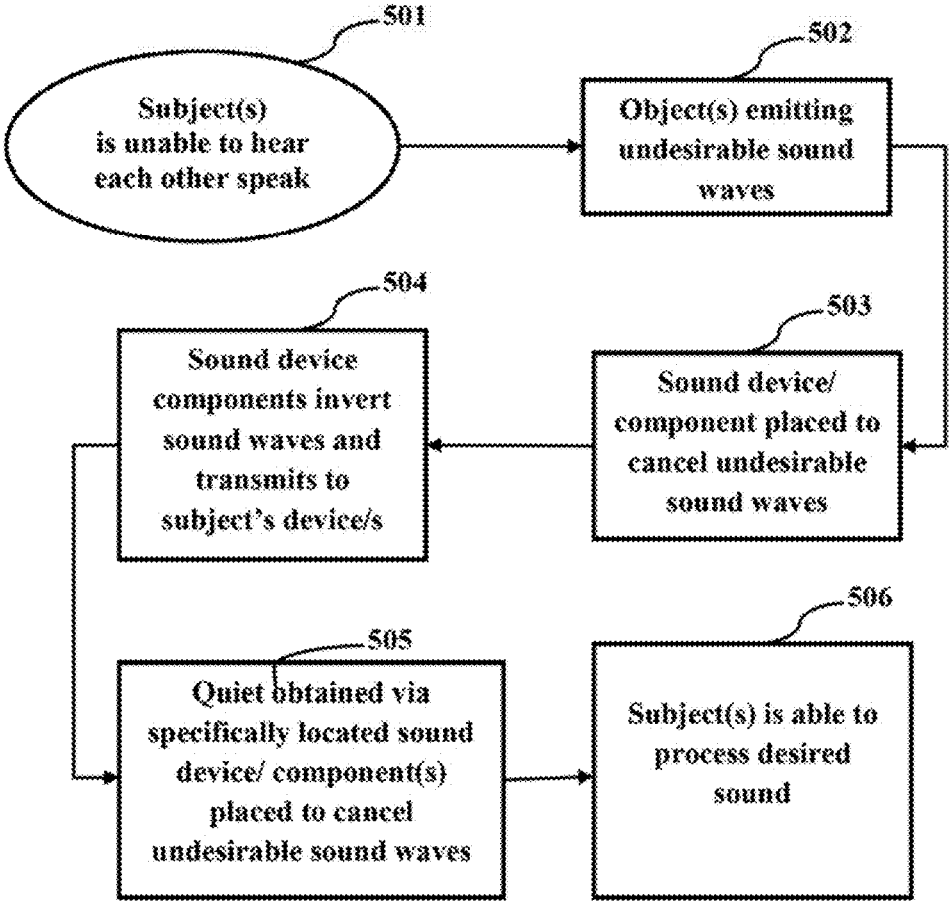
FIG. 5 is a flow chart illustrating a method for cancelling, reducing and/or modulating noise signal and for silencing noise signal in a designated space/area, according to one embodiment herein.

FIG. 5 is a flow chart illustrating a method for cancelling, reducing, and/or modulating noise signal and for silencing noise signal in a designated space, according to one embodiment herein. With respect to FIG. 5, the method is provided for cancelling, reducing, modulating and silencing noise signal in a designated space. The subjects or individuals in a designated space find that the subjects or individuals cannot process desired sounds/signals directly or over any user device due to undesirable sounds present in the designated space (501). The objects present in the designated space emit undesirable sounds or noise (502). A noise cancellation device is provided in the designated space to cancel the undesirable sounds or noise. a processing device comprising the signal inverting circuit is placed in the designated space to generate an inversion noise signal such that the amplitude of the generated inversion signal is inverse to the amplitude of the signal noise present in the designated space, while the frequency of the generated inversion signal is maintained at the same level of the signal noise present in the designated space. The generated inverted noise signal is transmitted and received with a FM transceiver (504). The received inverted signal is amplified and output through a transducer such as a speaker so that the amplified inverted noise signal is combined with the input signal noise to eliminate, cancel, modulate [enhance, or proof] the level of unwanted signal noise perceived by another subject/individual to generate a silence ambient in the designated space (505). The subjects/individuals present in the designated space are able to easily process desired sound/signals regardless of ambient noise. (506).

Figure 6:
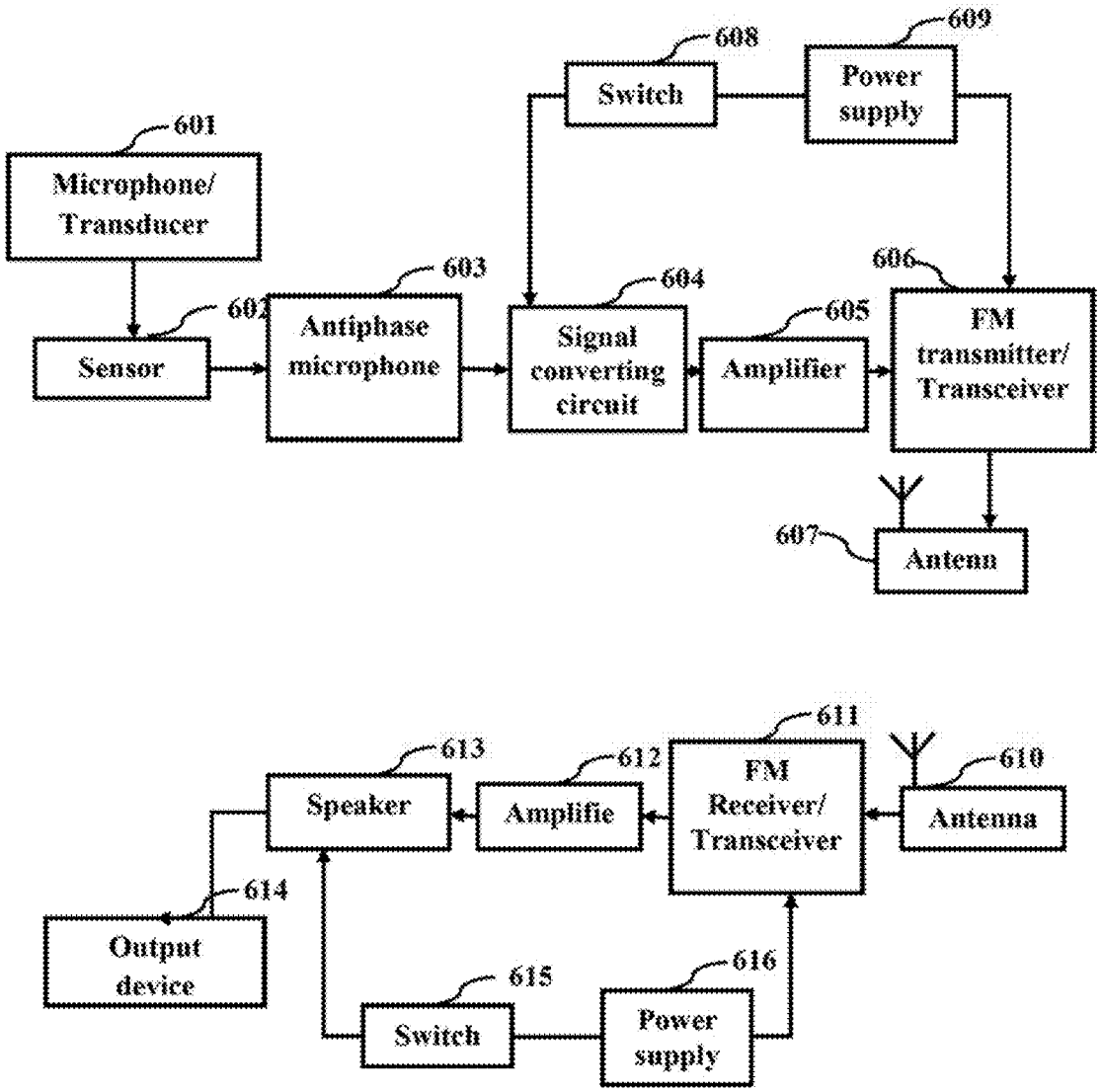
FIG. 6 illustrates a block circuit diagram of an apparatus for cancelling, reducing, modulating and/or silencing noise signal(s) and for signal enhancing and signal proofing, according to one embodiment herein.

FIG. 6 illustrates a block circuit diagram of an apparatus for cancelling, reducing, modulating, and silencing noise signal and for signal enhancing and signal proofing, according to one embodiment herein. With respect to FIG. 6, a microphone or transducer 601 is provided to capture the sound signals emitted in a designated space. The microphone 601 is provided as a standalone device or arranged in a mobile phone or any telephone device or computing device. The sensor 602 is provided for capturing noise or undesirable signals. The undesirable signal is a signal selected from a group comprising noise, undesirable sounds, visual stimuli, touch stimuli and taste stimuli. The examples of the sensors include, but are not limited to, a condenser microphone for sensing a sound signal, a lens for sensing light signal and a pressure gauge for sensing touch or sensation signal. The sensed signal noise is passed to a signal inverting circuit 604 for inverting the sensed signal noise through an antiphase microphone 603. The signal inverting circuit 604 inverts amplitude of the sensed signal noise without changing the frequency of the sensed signal noise. The signal inverting circuit 604 sends the inverted noise signal to a FM transmitter/transceiver 606 provided with an antenna 607 through an amplifier 605. The antenna 607 tuned to 88 MHz transmits the inverted signal noise to FM receiver//transceiver 611 tuned to 88 MHz. A power supply 609 along with a switch 608 (ON/OFF switch) is connected to the signal inverting circuit 604, amplifier 605 and FM transmitter/transceiver 606 to supply power during the entire process of generating and transmitting the inverted signal noise. Examples of the power supply 609 include, but are not limited to an Alternating Current (AC) source, a Direct Current (DC) source, a battery and a solar power source.

The FM receiver/transceiver 611 receives the inverted signal noise through the antenna 610. The amplifier 612 is connected to the FM receiver/transceiver 611 to amplify the inverted signal noise and sends the amplified inverted signal noise to a transducer such as a speaker 613. An example of the transducer 613 includes a speaker. The transducer such as speaker 613 outputs the amplified inverted noise signal to the surrounding area so that the amplified inverted noise signal combines with the signal noise to eliminate or cancel the level of unwanted signal noise perceived by a listener to generate a silence ambient in the designated space. A power supply 616 along with a switch 615 (ON/OFF switch) connected to the FM receiver/transceiver 611, amplifier 612 and transducer such as speaker 615 to supply power to the connected devices during the entire process of amplifying the inverted noise signal and producing the noise cancellation signal. Examples of the power supply 616 include, but are not limited to an Alternating Current (AC) source, a Direct Current (DC) source, a battery and a solar power source. The received inverted noise signal is mixed with the noise signal present in the enclosed space in an output device 614 such as mixer or multiplexer to cancel the noise signal present in the enclosed space to provide a silence environment inside the designated space are able to easily process desired sound/signals regardless of ambient noise.

In various embodiments, the elements are populated on a Printed Circuit Board (PCB) to form a Printed Circuit Board Assembly (PCBA) for generating the noise cancellation signal to cancel the signal noise so that the noise cancellation signal combines with the signal noise to eliminate the unwanted signal noise perceived by a listener.

Figure 7:
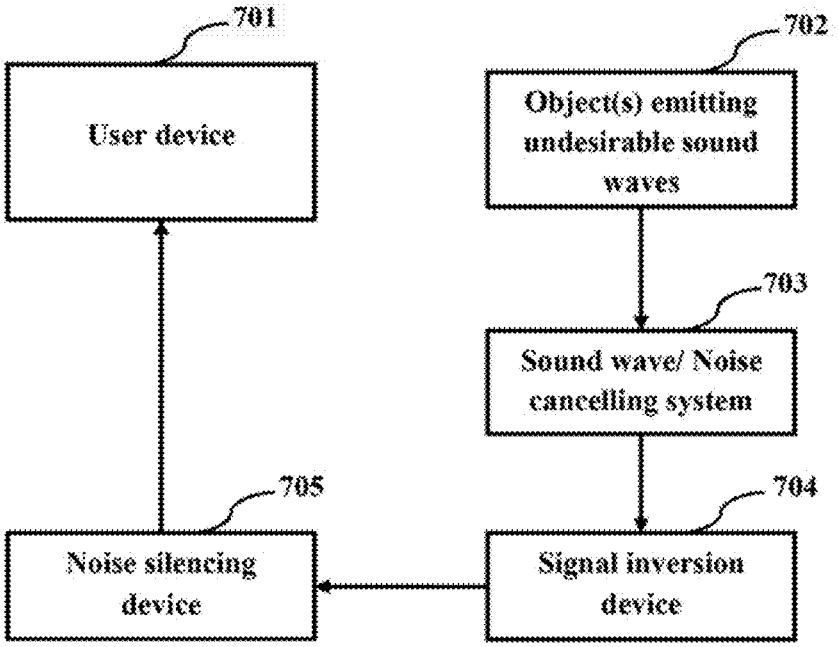
FIG. 7 is a block circuit diagram of a system for cancelling, reducing, modulating and/or silencing noise signal(s) in designated space(s)/area(s), according to one embodiment herein.

FIG. 7 is a block circuit diagram of a system for cancelling, reducing, and/or modulating noise signal and for silencing noise signal in a designated space, according to one embodiment herein. With respect to FIG. 7, the system is provided for cancelling, reducing, modulating and silencing noise signal in a designated space. The subjects or individuals in a designated space find that the subjects or individuals cannot process desired sounds/signals directly or over any user device 701 due to undesirable sounds present in the designated space. The objects 702 present in the designated space emit undesirable sounds or noise. A noise cancellation device 703 is provided in the designated space to cancel the undesirable sounds or noise. A processing device comprising the signal inverting circuit 704 is placed in the designated space to generate an inversion noise signal such that the amplitude of the generated inversion signal is inverse to the amplitude of the signal noise present in the designated space, while the frequency of the generated inversion signal is maintained at the same level of the signal noise present in the designated space. The generated inverted noise signal is transmitted and received with a FM transceiver. The received inverted signal is amplified and output through a transducer such as a speaker so that the amplified inverted noise signal is combined with the input signal noise in a mixer or noise silencing device 705 to eliminate or cancel the level of unwanted signal noise perceived by a listener to generate a silence ambient in the designated space. The subjects or individuals or speakers present in the designated space are able to easily process desired sound/signals regardless of ambient noise.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the invention is described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments herein which as a matter of language might be said to fall there between.

What is claimed is:

1. An apparatus for cancelling signal noise comprising:

a means for capturing undesirable signals, and wherein the means for capturing undesirable signal is a sensor or a receiver for detecting an undesirable signal, and wherein the sensor or receiver is automatically timed to the frequency of the undesirable signal;

a transducer for converting the energy of the captured undesirable signals;

a signal inverting circuit connected to the transducer, wherein the signal inverting circuit generates an output signal which is inverse of the undesirable signal captured by the means for capturing, and wherein the output signal from the signal inverting circuit has an amplitude which is amplitude of inverse captured, undesirable signal and a frequency which is same as the frequency of the captured, undesirable signal;

a means for transmitting connected to the signal inverting circuit to transmit the output of the signal inverting circuit, and wherein the means for transmitting is a frequency modulated (FM) transmitter;

a means for communication and wherein the means for communications is a partially wired and partially wireless network and wherein the means for communications is an optical communication network;

a means for receiving the output of the signal inverting circuit transmitted by the means for transmitting, and wherein the means for receiving is a FM receiver and amplifier;

a signal output device to output the signal received by the means for receiving, and wherein the output signal cancels the signal noise;

a power supply and wherein the power supply is selected from a group consisting of an Alternating Current (AC) source, a Direct Current (DC) source, a battery and a solar power source; and a switch;

wherein the power supply along with the switch is connected to the signal inverting circuit and the FM transmitter to supply power during an entire process of generating and transmitting the inverted signal noise, and wherein the receiver is manually or automatically or remotely controlled to vary the volume of an output signal from the receiver with respect to a volume of a noise to vary a degree of noise cancellation.

2. The apparatus ac cording to claim 1, wherein the signal output device outputs the output of the signal inverting circuit signal received, by the means for receiving to cancel the undesirable signal and wherein the output of the signal inverting circuit signal combines with the noise signal to cancel or reduce or eliminate the undesirable signal.

3. The apparatus according to claim 1, wherein the sensor or the receiver has a feature for adjusting the volume of the specific signal for achieving any desired degree of noise cancellation.

4. The apparatus according to claim 1, wherein the undesirable signal is a signal selected from a group consisting of noise, and undesirable sounds.

5. The apparatus according to claim 1, wherein the means for communications is a wired network to communicate the output of the signal inverting circuit, which is transmitted using the means for transmitting.

6. The apparatus according to claim 1, wherein the means for communications is a wireless network to communicate the output of the signal inverting circuit, which is transmitted using the means for transmitting.

7. The apparatus according to claim 1, wherein the sensor or receiver manually tuned to the frequency of the undesirable signal.

8. The apparatus according to claim 1, wherein the sensor or receiver is remotely tuned to the frequency or frequencies of the undesirable signal or signals.

9. The apparatus according to claim 1, wherein the sensor or receiver is automatically tuned to the frequency or frequencies of the undesirable signal or signals.

10. The apparatus according to claim 1, wherein the sensor or receiver is tuned to receive an entire spectrum of noise or sound frequency external to or internally of designated space/areas.

11. The apparatus according to claim 1, wherein the signal inverting circuit generates an inverse signal of the entire spectrum of received noise or sound frequency.

12. The apparatus according to claim 1, wherein one or more microphones, speakers, transmitters, transducers and/ or receivers are integrated to amplify localized sound against ambient noise that is silenced or cancelled.

13. The apparatus according to claim 1, wherein one or more microphones, speakers, transmitters, transducers and/or receivers are integrated to silence localized sound in addition to ambient noise via noise cancelation.

14. The apparatus according to claim 1, wherein one or more phase and/or antiphase microphones speakers, transmitters, transducers, and receivers are integrated for silencing or amplifying sound inside the designated space/area in addition to silencing noise originating externally to or internally in the designated space.

15. The apparatus according to claim 1, further comprises computing and telephone devices integrated with one or more phase and/or antiphase microphones, speakers; transmitters, transducers, and receivers for automatic, manual and/or remote controlling of volume control settings and tuning frequency control settings.

16. The apparatus according to claim 1, wherein one or more phase and antiphase microphones, speakers, transmitters, transducers, and receivers are provided with a directional sensor or sensors to isolate sounds in a designated space/area for providing signal noise modulation, signal noise reduction, signal noise cancellation, signal enhancement, and signal-proofing.

17. The apparatus according to claim 1, wherein one or more phase and/or antiphase microphones, speakers, transmitters, transducers, and receivers are provided with geotags for enabling user to remotely, automatically, and/or manually adjust the settings so that the one or more phase and/or antiphase microphones, speakers, transmitters, transducers, and receivers remember the selected settings to prevent a resetting operation, when the user enters a preset location at succeeding times or next time.

18. The apparatus according to claim 1, further comprises a whistle protection application for reducing any feedback.

19. The apparatus according to claim 1, further comprises noise memory application to enable the apparatus to store with sound/frequency patterns of noises so that an active noise cancellation is activated remotely, automatically, and/or manually, similar to memory car seats used for recalling a driver's preset seat position in a vehicle, when a noise is recognized based on the stored noise frequency or noise pattern in a designated space/area.

20. The apparatus according to claim 1, further comprises noise anticipation application so that the apparatus anticipates noise heuristically, similar to Pandora software for music used for anticipating the listener's music choices.

21. A method for cancelling signal noise comprises:

capturing undesirable signals, wherein the undesirable signals are captured using a sensor or receiver and wherein the sensor or receiver is automatically, remotely or manually tuned to the frequency of the undesirable signal, and wherein the sensor or the receiver adjusts a volume of the undesirable signal for achieving any desired degree of noise cancellation;

generating an inverse signal of the captured undesirable signal by passing the captured undesirable signal through a signal inverting circuit, wherein the inverse of the captured undesirable signal has an amplitude which is amplitude of inverse captured, undesired signal and a frequency which is same as the frequency of the captured, undesirable signal;

transmitting the generated inverse of the captured undesirable signal through a wired or wireless network and wherein the transmitted inverse of the captured undesirable signal is communicated through an optical communication network;

communicating the transmitted signal;

receiving the transmitted inverse of the captured undesirable signal;

and outputting the received inverse of the captured undesirable signal to cancel the undesirable signal and wherein the signal noise is cancelled by replicating or mirroring a signal so that a subject or individual is unaware of the undesirable signal and is able to focus on a desired signal, and wherein the receiver is manually or automatically or remotely controlled to vary a volume of an output signal from the receiver with respect to a volume of a noise to vary a degree of noise cancellation.

22. The method according to claim 21, wherein the undesirable signal is a signal selected from a group consisting of noise, and undesirable sounds.

23. The method according to claim 21, wherein the transmitted inverse of the captured undesirable signal is communicated through a wired network.

24. The method according to claim 21, wherein the transmitted inverse of the captured undesirable signal is communicated through a wireless network.

25. The method according to claim 21, wherein the sensor or receiver manually tuned to the frequency of the undesirable signal.

26. The method according to claim 21, wherein the sensor or receiver is remotely tuned to the frequency of the undesirable signal.

27. The method according to claim 21, wherein the sensor or receiver is automatically timed to the frequency of the undesirable signal.

28. The method according to claim 21, wherein the receiver is manually controlled to vary the volume of an output signal from the receiver with respect to a volume of a noise to vary a degree of noise cancellation.

29. The method according to claim 21, wherein the receiver is remotely controlled to vary the volume of an output signal from the receiver with respect to a volume of a noise to vary a degree of noise cancellation.

30. The method according to claim 21, wherein the receiver is automatically controlled to vary the volume of an output signal from the receiver with respect to a volume of a noise to vary a degree of noise cancellation.

31. The method according to claim 21, wherein the sensor or receiver is tuned to receive an entire spectnml of noise or sound frequency coming from an area external to or internally in a designated space/area.

32. The method according to claim 21, wherein the signal inverting circuit generates an inverse signal of the entire spectrum of received noise or sound frequency.

* * * * *